US005941727A

United States Patent [19]

Kodama

[11] Patent Number: 5,941,727

[45] Date of Patent: Aug. 24, 1999

[54] FITTING STRUCTURE AND METHOD OF A LEVER CONNECTION

[75] Inventor: Shinji Kodama, Shizuoka, Japan

[73] Assignee: Yazaki Corporation, Tokyo, Japan

[21] Appl. No.: 08/931,828

[22] Filed: Sep. 16, 1997

[30] Foreign Application Priority Data

Sep. 30, 1996 [JP] Japan ..... 8-258955

[51] Int. Cl.[6] ..... H01R 13/64

[52] U.S. Cl. ..... 439/372

[58] Field of Search ..... 439/372, 152–160, 439/310

[56] References Cited

U.S. PATENT DOCUMENTS 5,499,926 3/1996 Akeda ..... 439/372

*Primary Examiner*—Steven L. Stephan
*Assistant Examiner*—Eugene G. Byrd
*Attorney, Agent, or Firm*—Sughrue, Mion, Zinn, Macpeak & Seas, PLLC

[57] ABSTRACT

In the fitting structure of a lever connector according to the present invention, after a first connector 10 and a second connector 20 are completely fitted and the swing of a lever 11 is disabled, the lever 11 can be displaced in an equipment attachment direction in a housing 30. When the equipment C further approaches the housing 30, the engagement between a flexible locking arm 32 and the lever 11 is released by flexing the flexible locking arm 32 by the lever. Therefore, the flexible locking arm 32 does not prevent the equipment C from being displaced on the side of the housing 30 and the equipment C can be securely attached to the housing 30.

5 Claims, 8 Drawing Sheets

FITTING STRUCTURE AND METHOD OF A LEVER CONNECTION

BACKGROUND OF THE INVENTION

The present invention relates to a fitting structure and method of a lever connector in which a connector on the other side is pulled near by swinging a lever supported by a connector on one side of a pair of connectors fitted to each other so that the lever can be swung and both connectors can be completely fitted with small force, more particularly relates to technique for improving the fitting structure and method of a lever connector so that both connectors can be completely fitted even if the lever connector is installed between equipment assembled each other.

Heretofore, various types of connectors fitted to each other to connect electrical wiring are used and of these connectors, a so-called lever connector provided with a lever supported by a connector on one side of a pair of connectors so that the lever can be swung wherein the pair of connectors can be completely fitted with small force by swinging the lever is included.

If a connector disclosed in Japanese Patent Unexamined Publication No. Hei. 5-114436 is described referring to FIGS. 1 and 2 as an example of the structure of the above lever connector, a lever 2 is supported by a first connector 1 so that the lever can be swung. The lever 2 is attached around a supporting shaft 2*a* so that the lever can be swung therearound and is provided with a fitting groove 2*b* for fitting the lever to a fitting pin 3*a* protruded from a second connector 3.

Hereby, when the lever 2 is swung on the side of the second connector 3 with the fitting pin 3*a* fitted into the fitting groove 2*b* of the lever 2 after the second connector 3 is temporarily fitted to the first connector, the second connector 3 is pulled on the side of the first connector 1 and both connectors 1 and 3 can be completely fitted with small force.

In the meantime, the first connector 1 is housed and held inside a housing 5 fixed on a panel 4 and is so constituted that the first connector 1 is not required to be held by a hand when the first connector 1 and the second connector 3 are fitted.

The housing 5 is provided with a contact part 5*a* for coming in contact with the end of the lever 2 of the housed first connector 1 and plural guide member 5*b* for supporting the first connector 1 so that the first connector 1 is not tilted when the first connector 1 is pushed by the second connector 3 and displaced in the housing 5.

Hereby, when the second connector 3 is inserted into the housing 5 to fit the second connector to the first connector 1, the first connector 1 is pushed by the second connector 3 and displaced in the housing 5 leftward in FIG. 1. As a result, as the lever 2 which is in contact with the contact part 5*a* of the housing 5 is swung clockwise around the supporting shaft 2*a* and pulls the second connector 3, the second connector 3 can be completely fitted to the first connector 1.

A connector may be constituted so that the above second connector 3 is directly attached to equipment B shown by a two-dot long and two short dashes line in FIGS. 1 and 2 and the second connector 3 is fitted to the first connector 1 at the same time when the equipment B is attached to the housing 5.

However, since in the above connector according to prior technique, the end of the lever 2 is still in contact with the contact part 5*a* after the first connector 1 and the second connector 3 are completely fitted and the swing of the lever 2 is disabled, the first connector 1 and the second connector 3 cannot be further displaced in the housing 5 leftward in FIG. 1.

Hereby, if the first connector 1 and the second connector 3 are completely fitted before the equipment B comes in contact with the housing 5, there is a problem depending upon a state in which each component is assembled that the second connector 3 cannot be inserted into the housing 5 moreover. Hence, the equipment B cannot be attached to the housing 5.

On the contrary, if the attachment of the equipment B to the housing 5 is completed in a state in which the fitting of the first connector 1 and the second connector 3 is not completed, there is a problem that the first connector 1 and the second connector 3 cannot be pushed into the housing 5 moreover. Hence, the lever 2 is not sufficiently swung, so that the first connector 1 and the second connector 3 cannot be completely fitted.

SUMMARY OF THE INVENTION

It is an object of the present invention to solve the above problems of the conventional technique, and particularly to provide a fitting structure and method of a lever connector wherein a first connector housed in a housing and a second connector directly attached to equipment can be securely fitted when the equipment is attached to the housing.

The above object of the present invention can be achieved by a fitting structure of a lever connector comprising:

equipment attached to a housing;

a first connector housed in the housing;

a second connector directly attached to the equipment and fitted to the first connector when the equipment is attached to the housing;

a lever supported by the first connector so that the lever can be swung to pull the second connector on the side of the first connector and fit both connectors completely; and a flexible member engaged with the end of the lever and formed in the housing to swing the lever according to the displacement of the first connector in an equipment attachment direction, wherein:

the lever connector is constituted so that the first and second connectors are completely fitted before the attachment of the equipment to the housing is completed; and when the first and second connectors are completely fitted and the lever is displaced in the housing in the equipment attachment direction in a state that the swing of the lever disabled, the flexible member is bent by the lever and an engagement between the flexible member and the lever is released.

In addition, the above object of the present invention can be achieved by a fitting method for a lever connector comprising, equipment attached to a housing, a first connector housed in the housing, a second connector directly attached to the equipment and fitted to the first connector when the equipment is attached to the housing, and a lever supported by the first connector so that the lever can be swung to pull the second connector on the side of the first connector and fit both connectors completely, the fitting method comprising the steps of:

providing a flexible member engaged with the end of the lever and formed in the housing to swing the lever according to the displacement of the first connector in an equipment attachment direction;

completely fitting the first and second connectors to each other before the attachment of the equipment to the housing is completed;

bending the flexible member by the lever so as to release an engagement between the flexible member and the lever when the first and second connectors are completely fitted and the lever is displaced in the housing in the equipment attachment direction in a state that the swing of the lever disabled; and completely attaching the equipment to the housing after the step of bending.

That is, in the fitting structure of a lever connector according to the present invention, the first and second connectors are completely fitted before the attachment of the equipment to the housing is completed. Hereby, when the attachment of the equipment to the housing is completed, the first and second connectors have already been completely fitted.

When the first and second connectors are completely fitted and the lever is displaced in the housing with the swing of the lever disabled, the flexible member is pressed and bent by the lever and the engagement between the flexible member and the lever is released. Hereby, as the displacement of the first and second connectors in the housing, that is, the displacement of the equipment to the side of the housing is not prevented after the first and second connectors are completely fitted by contact between the flexible member and the lever, the equipment can be securely attached in the housing.

DETAILED DESCRIPTION OF THE PREFERRED EMBODIMENTS

Figure 1:
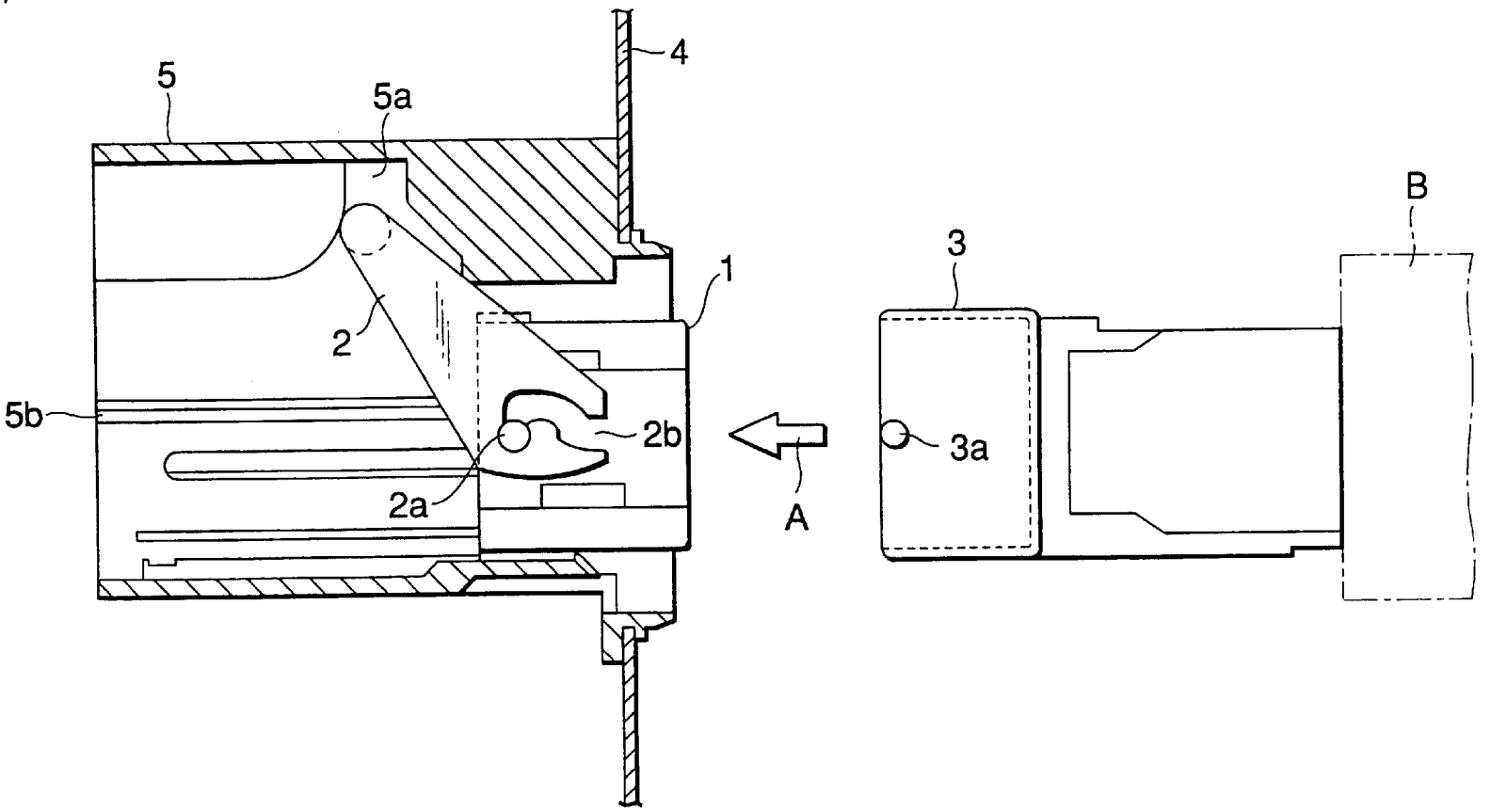
FIG.1 PRIOR ART
FIG. 1 is a schematic explanatory drawing showing the fitting structure of a conventional type lever connector.
Figure 2:
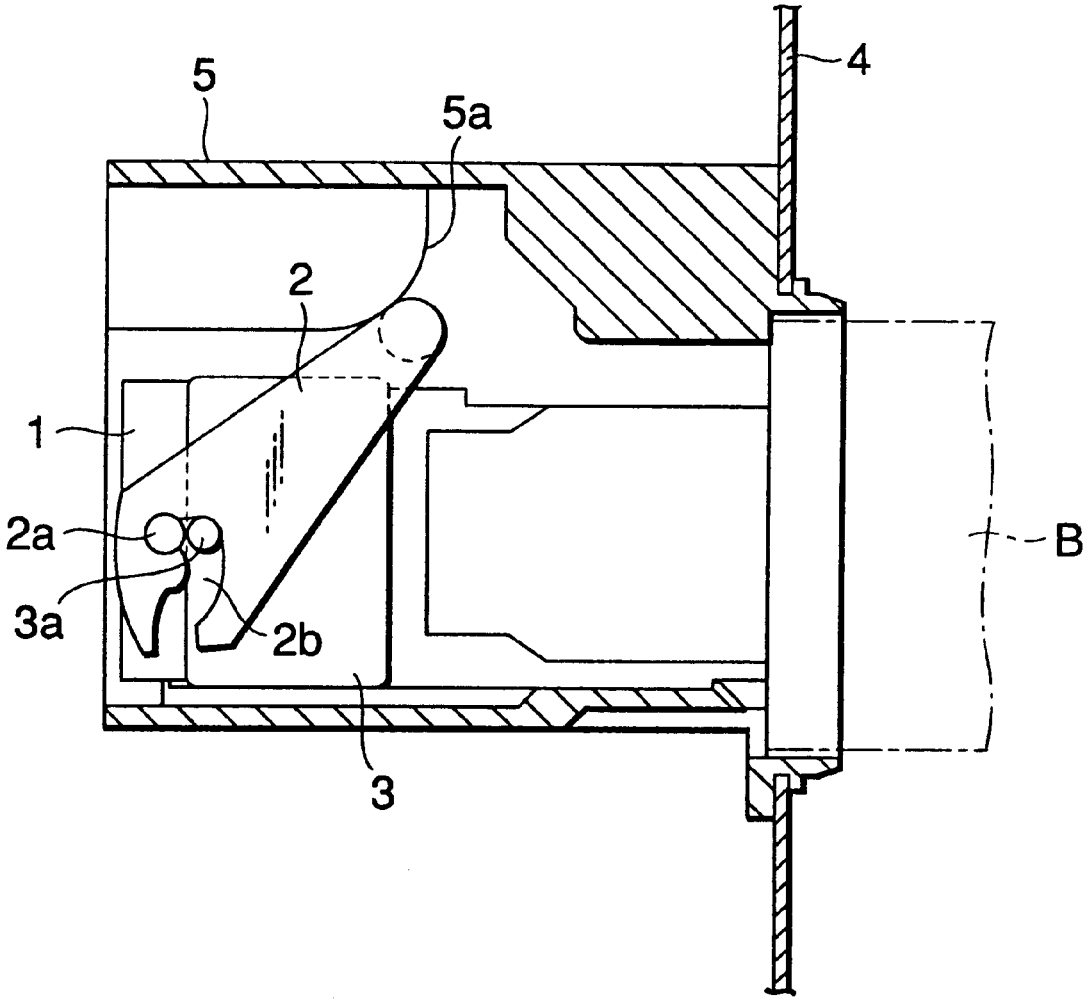
FIG.2 PRIOR ART
FIG. 2 is an actional explanatory drawing showing a state in which the first and second connectors respectively shown in FIG. 1 are completely fitted.
Figure 3:
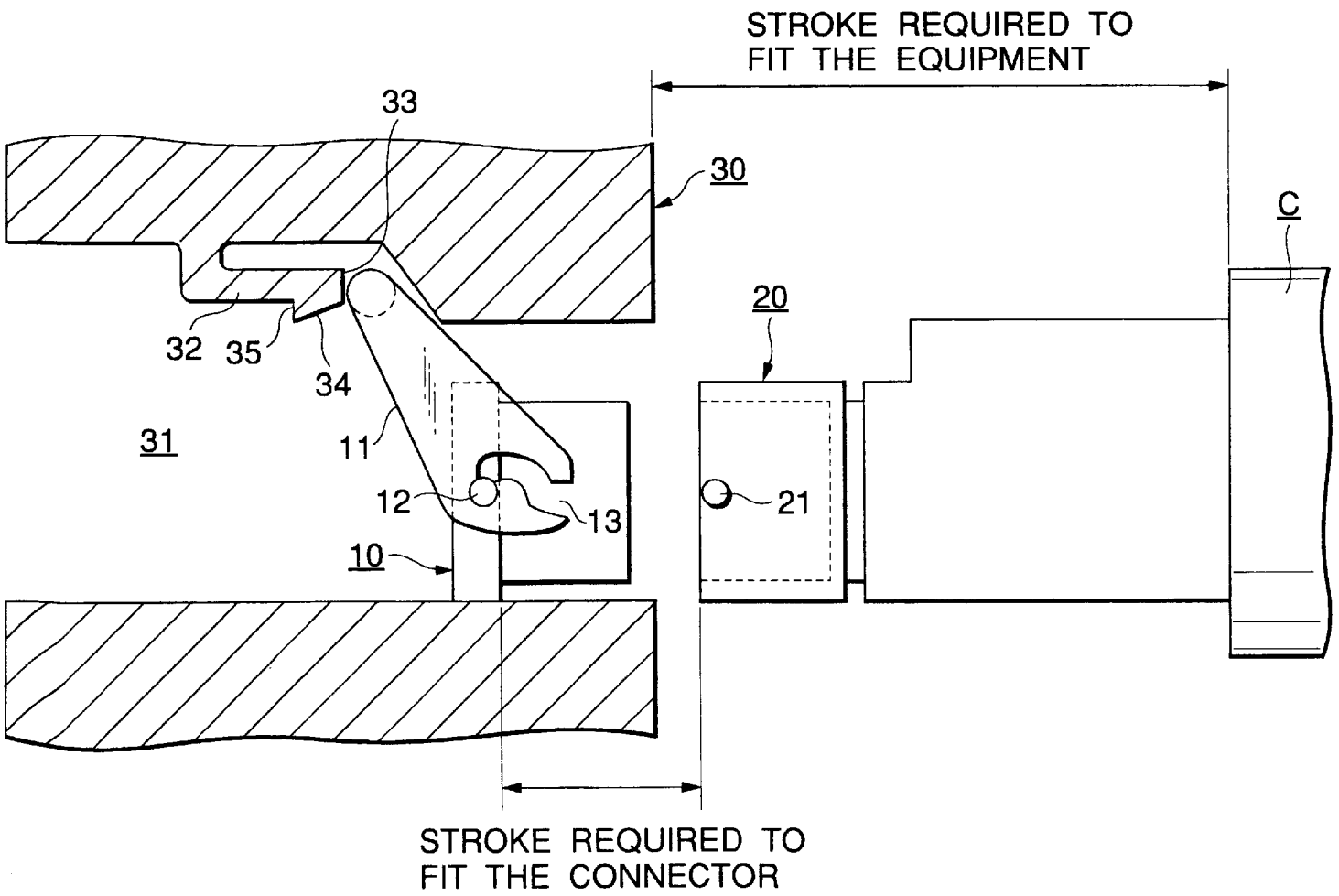
FIG. 3 is a schematic explanatory drawing showing an embodiment of the fitting structure of a lever connector according to the present invention.
Figure 4:
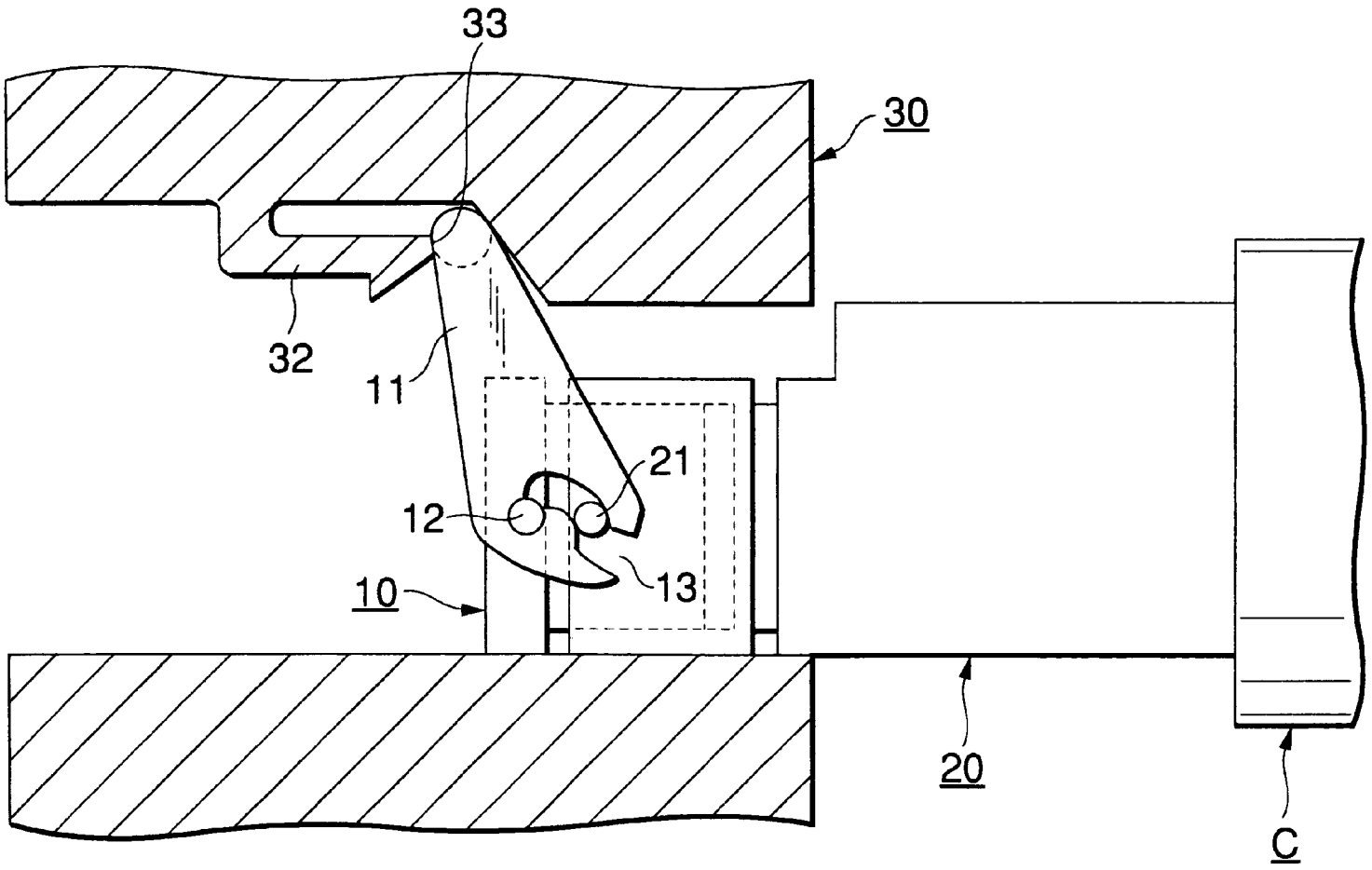
FIG. 4 is an actional explanatory drawing showing a halfway state in which first and second connectors respectively shown in FIG. 3 are being fitted.
Figure 5:
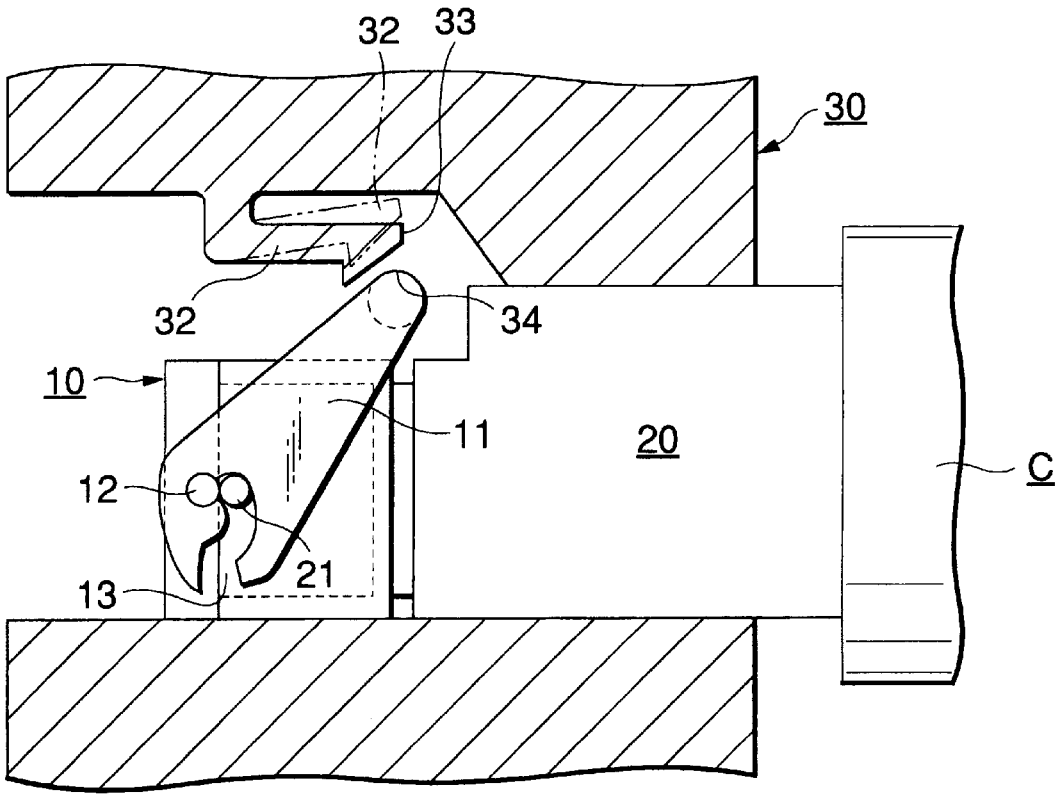
FIG. 5 is an actional explanatory drawing showing a state in which the first and second connectors respectively shown in FIG. 3 are completely fitted.
Figure 6:
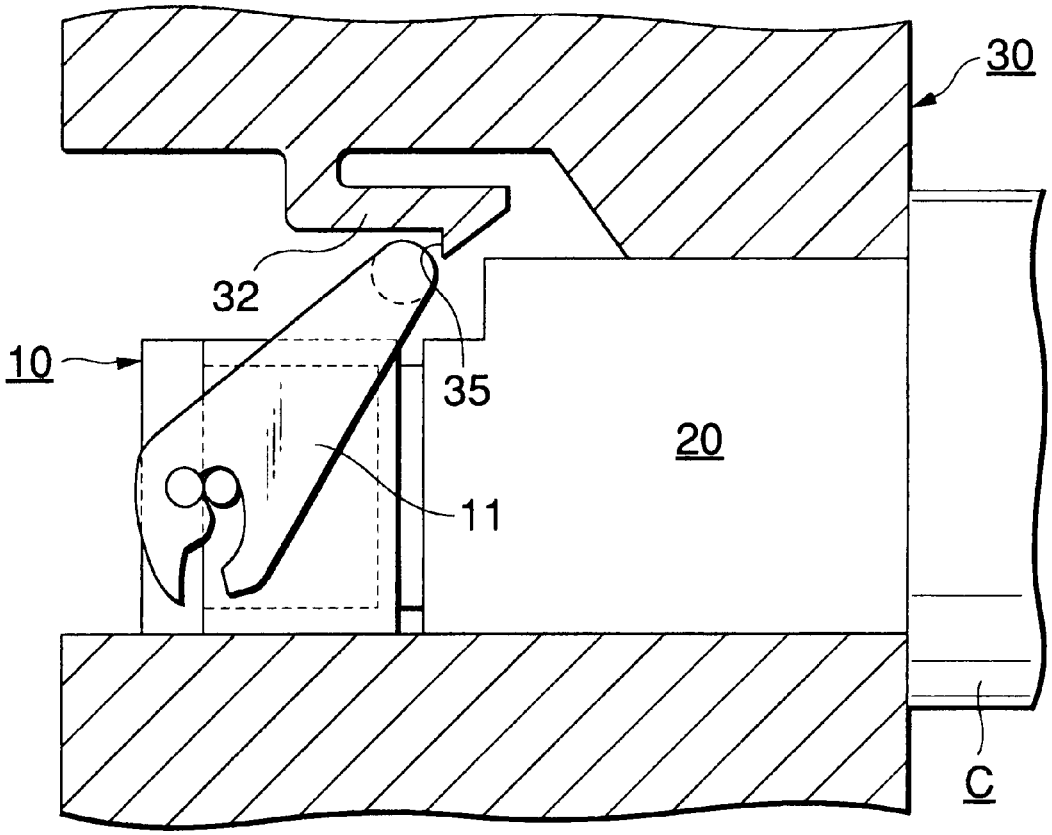
FIG. 6 is an actional explanatory drawing showing a state in which equipment shown in FIG. 3 is attached to a housing.
Figure 7A:
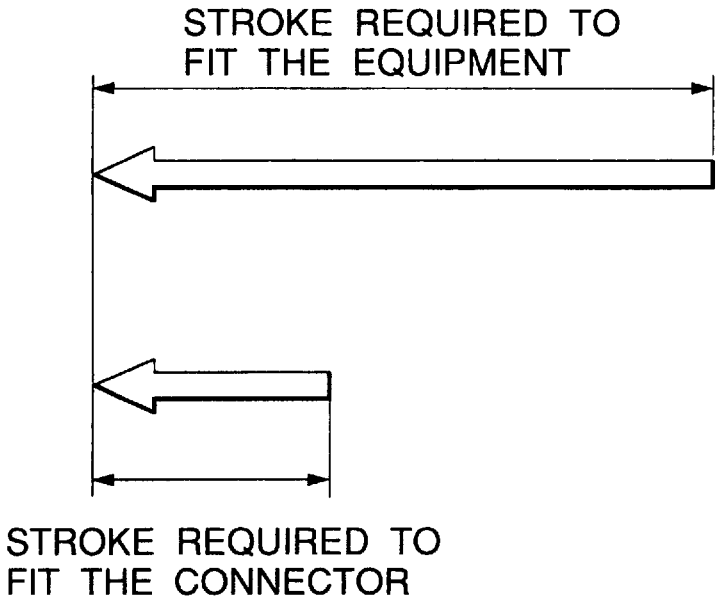
FIGS. 7(*a*) and 7(*b*) are explanatory drawings showing relative relationship between an equipment attachment stroke and a connector fitting stroke in the present invention and the prior art.
Figure 7B:
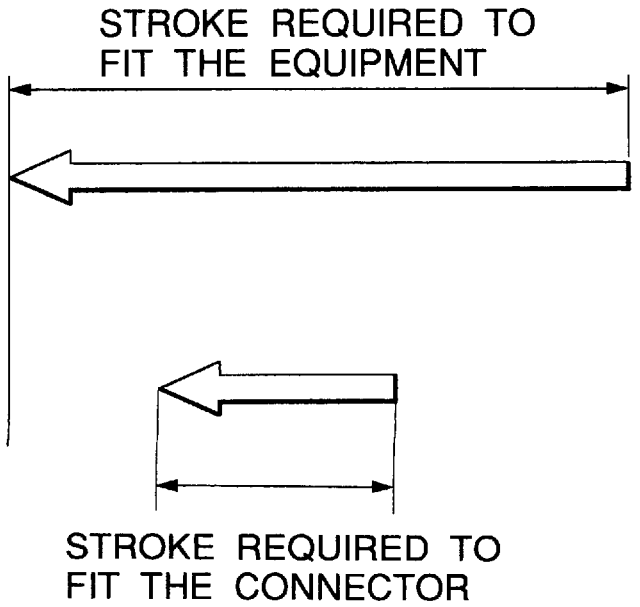
Figure 8A:
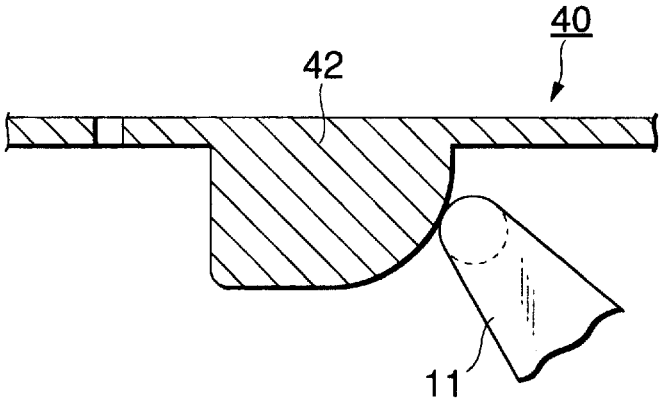
FIGS. 8(*a*)–8(*c*) are actional explanatory drawings showing another embodiment of the fitting structure of a lever connector according to the present invention, FIG. 8(*a*) shows a state before the housing is flexed, FIG. 8(*b*) shows a state in which the housing is being flexed and FIG. 8(*c*) shows a state after the housing is flexed.
Figure 8B:
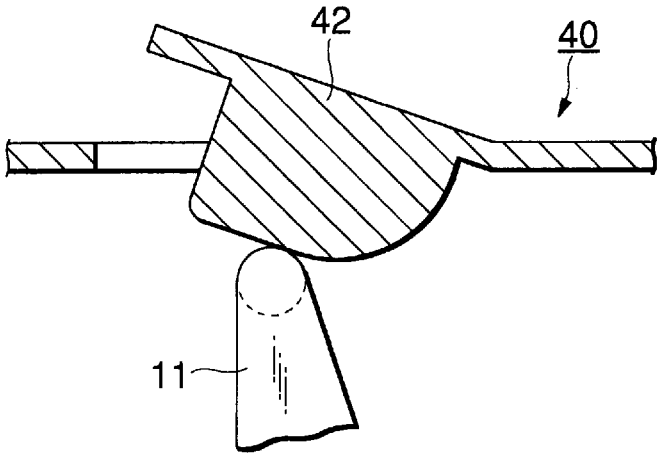
Figure 8C:
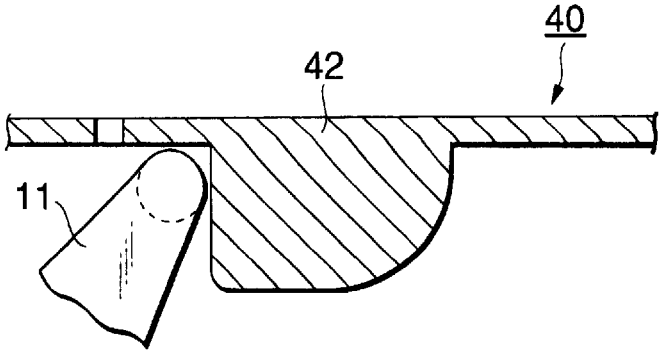

Referring to FIGS. 3 to 7, an embodiment of the fitting structure of a lever connector according to the present invention will be described in detail below. FIG. 3 is a schematic explanatory drawing showing the constitution of the main part of the fitting structure of a lever connector according to the present invention in an embodiment, FIG. 4 is an actional explanatory drawing showing a halfway state in which first and second connectors are fitted to each other in FIG. 3, FIG. 5 is an actional explanatory drawing showing a state in which the first and second connectors in FIG. 3 are completely fitted, FIG. 6 is an actional explanatory drawing showing a state in which equipment in FIG. 3 is attached to a housing, FIG. 7 is an explanatory drawing showing relative relationship between an equipment attachment stroke and a connector fitting stroke in the present invention and the prior art and FIG. 8 is an actional explanatory drawing showing the main part of the fitting structure of a lever connector according to the present invention in an another embodiment.

As shown in FIG. 3, the fitting structure of a lever connector in this embodiment is provided with a first connector 10, a second connector 20 fitted to the first connector 10, a housing 30 for housing the first connector 10 and equipment C attached to the housing 30.

The second connector 20 is directly attached to the equipment C and constituted so that the second connector is inserted into the housing 30 and fitted to the first connector 10 when the equipment C is attached to the housing 30.

The first connector 10 is housed in the housing 30 so that the first connector 10 can be displaced in a direction in which the equipment C is attached to the housing 30, that is, leftward in FIG. 3. A lever 11 is supported by the first connector 10 so that the lever can be swung. The lever 11 is swung around a supporting shaft 12 and provided with a fitting groove 13 which can be fitted to a fitting pin 21 protruded from the side of the second connector 20.

When the lever 11 is swung on the side of the second connector 20 with the fitting pin 21 fitted into the fitting groove 13 of the lever 11 after the second connector 20 is temporarily fitted to the first connector 10, the fitting pin 21 is displaced along the cam face of the side wall of the fitting groove 13. Hereby, as the second connector 20 can be pulled on the side of the first connector 10 by the swing of the lever 11, the second connector 20 can be completely fitted to the first connector 10 with small force.

In the meantime, the second connector 20 is directly attached to the equipment C to be attached to the housing 30. Hereby, while the equipment C is being attached to the housing 30, the second connector 20 is inserted into the housing 30 and fitted to the first connector 10.

The housing 30 is provided with a connector housing chamber 31 for housing the first connector 10. A cantilever flexible locking arm 32 extended toward the equipment C is formed in the upper part of the connector housing chamber 31. The end of the flexible locking arm 32 as a flexible member functions as a fitting part 33 for fitting to the end of the lever 11 in the direction in which the equipment C is attached. A tilted face 34 and a fitting pawl 35 are integrally provided on the lower end of the fitting part 33, as shown in FIG. 3.

Next, referring to FIGS. 3 to 7, the fitting action of the fitting structure of the lever connector in this embodiment constituted as described above will be described.

As shown in FIG. 3, when the first connector 10 is housed in the housing 30, the first connector 10 is supported by supporting means not shown and formed on the inner wall of the connector housing chamber 31 and can be displaced in the direction in which the equipment C is attached (leftward in each drawing) without being tilted when the first connector is pushed by the second connector 20.

Simultaneously, the end of the lever 11 is opposed to the fitting part 33 at the end of the flexible locking arm 32.

A stroke required to fit the first connector 10 and the second connector 20 completely is set so that the stroke is shorter than a stroke required to attach the equipment C to the housing 30.

When the second connector 20 is inserted into the housing 30 to attach the equipment C to the housing 30, the second connector 20 is temporarily (incompletely) fitted to the first connector 10 and the fitting pin 21 protruded from the side surface of the second connector 20 enters the fitting groove 13 of the lever 11 as shown in FIG. 4.

Simultaneously, as the first connector 10 is pushed by the second connector 20 and displaced leftward in FIG. 4 in the housing 30, the end of the lever 11 is engaged with the fitting part 33 disposed at the end of the flexible locking arm 32 and the lever 11 is a little swung clockwise around the supporting shaft 12.

When the equipment C approaches the housing 30, the second connector 20 is further inserted into the housing 30 and pushes the first connector 10. Hereby, as the first connector 10 is further displaced leftward in FIG. 4 in the housing 30, the lever 11 is pressed by the flexible locking arm 32 and is greatly swung clockwise around the supporting shaft 12. As a result, the second connector 20 is pulled on the side of the first connector 10 by the lever 11 and is completely fitted to the first connector 10.

At this time, the end of the lever 11 greatly swung is opposed to the tilted face 34 at the end of the flexible locking arm 32. Hereby, the first connector 10 and the second connector 20 are further displaced leftward in FIG. 4 together with the equipment C, the flexible locking arm 32 is bent by the lever 11 as shown by a two-dot long and two short dashes line in FIG. 5 and the engagement between the flexible locking arm and the lever 11 in the equipment attachment direction (leftward in FIG. 5) is released.

However, in a state in which the first connector 10 and the second connector 20 are completely fitted, the equipment C is not in contact with the housing 30 yet as shown in FIG. 5.

In a state in which the equipment C is further displaced leftward in FIG. 5 and is brought in contact with the housing 30, the end of the lever 11 is located leftside of the fitting pawl 35 positioned at the end of the flexible locking arm 32 as shown in FIG. 6.

That is, since the end of the lever 11 is located below the flexible locking arm 32 extended vertically in a state immediately before the equipment C comes in contact with the housing 30, the flexible locking arm 32 is not engaged with the lever 11. Therefore, the first connector 10 and the second connector 20 are not prevented from being displaced leftward in FIG. 6, that is, the equipment is not prevented from approaching the housing 30.

In the meantime, when the equipment C is displaced in a direction in which the equipment C is separated from the housing 30 (rightward in FIG. 6), the end of the lever 11 integrally displaced with the equipment C is engaged with the fitting pawl 35 disposed at the end of the flexible locking arm 32.

Hereby, as the lever 11 is swung counterclockwise around the supporting shaft 12 and the fitting of the second connector 20 to the first connector 10 is released, the second connector 20 can be separated from the first connector 10 with the second connector 20 integrated with the equipment C.

That is, in the fitting structure of the lever connector in this embodiment, a stroke required to fit the first connector 10 and the second connector 20 completely is set so that it is shorter than a stroke required to attach the equipment C to the housing 30.

In addition, differently from a conventional type connector shown in FIG. 7(*a*), the end of the equipment attachment stroke and the end of the connector fitting stroke are not simultaneous and as shown in FIG. 7(*b*), the lever connector in this embodiment is constituted so that the end of the connector fitting stroke is earlier than the end of the equipment attachment stroke.

Hereby, before the equipment C is attached to the housing 30, the first connector 10 and the second connector 20 can be completely fitted.

Further, after the first connector 10 and the second connector 20 are completely fitted and the swing of the lever 11 is disabled, the lever 11 is displaced in the equipment attachment direction in the housing 30. That is, as the flexible locking arm 32 is bent by the lever 11 and the engagement between the flexible locking arm and the lever 11 is released when the equipment C further approaches the housing 30, the displacement of the equipment C to the side of the housing 30 is not prevented by the flexible locking arm 32. Therefore, the equipment C can be securely attached to the housing 30.

The fitting structure of the lever connector in this embodiment is described above in detail, however, the present invention is not limited to the above embodiment and it need scarcely be said that various variations are allowed. For example, in the above embodiment, the cantilever flexible locking arm 32 is extended toward the equipment C, however, the constitution can be suitably changed.

For example, a projection 42 is provided inside a housing 40 in place of the flexible locking arm as shown in FIG. 8(*a*) and constituted so that the housing 40 is bent outside when larger pressure than predetermined one is applied to the housing 40 outwardly. In a state shown in FIG. 8(*a*), the lever 11 is in contact with the front end of the projection 42 until the fitting of both connectors is completed and the swing of the lever is disabled. As the position of operation upon the projection 42 is lowered when the lever 11 is displaced in an equipment attachment direction in the housing 40 as shown in FIG. 8(*b*), the part of the housing 40 equivalent to the projection 42 is bent outside. Hereby, the engagement between the projection and the lever 11 is released, the lever 11 is moved to the rear end of the projection 42 as shown in FIG. 8(*c*) and the equipment can be attached to the housing 40.

In further another embodiment, the same action and effect as described above can be also obtained by providing a function in which the lever itself can be bent when larger pressure than predetermined one is applied to the lever 11 to the lever.

As described above, the fitting structure of the lever connector according to the present invention is provided with the equipment to be attached to the housing, the first connector housed in the housing, the second connector directly attached to the equipment and fitted to the first connector when the equipment is attached to the housing, the lever pulling the second connector on the side of the first connector and supported by the first connector so that the lever can be swung to fit both connectors completely and the flexible locking arm fitted to the end of the lever and formed in the housing to swing the lever according to the displacement of the first connector in the equipment attachment direction, is constituted so that the first and second connectors are completely fitted before the attachment of the equipment to the housing is completed, and when the first and second connectors are completely fitted and the lever is displaced in the equipment attachment direction in the housing with the swing of the lever disabled, the flexible locking arm is bent by the lever and the engagement between the flexible locking arm and the lever is released.

Therefore, before the equipment is attached to the housing, the first and second connectors can be completely fitted and when the equipment further approaches the housing after the first and second connectors are completely fitted and the swing of the lever is disabled, the engagement between the flexible locking arm and the lever is released by the flexure of the flexible locking arm. Therefore, the flexible locking arm does not prevent the equipment from being displaced on the side of the housing and the equipment can be securely attached to the housing.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A fitting structure of a lever connector for attaching equipment to a housing comprising:

a first connector housed in said housing;

a second connector directly attached to said equipment and fitted to said first connector when said equipment is attached to said housing;

a lever supported by said first connector so that the lever can be rotated to pull said second connector on the side of said first connector and fit both connectors completely; and a flexible member initially engaged with the end of said lever and formed in said housing to allow said lever to rotate upon the displacement of said first connector in an equipment attachment direction, wherein:

said lever connector is constituted so that said first and second connectors are completely fitted to each other before the attachment of said equipment to said housing is completed; and when said first and second connectors are completely fitted and said lever is displaced in said housing in the equipment attachment direction in a state that the rotation of said lever is disabled, said flexible member is bent by said lever so as to disengage said lever from said flexible member.

2. The fitting structure of a lever connector according to claim 1, wherein said flexible member comprises a cantilever flexible locking arm which is extended toward said equipment and is formed in the upper part of connector housing chamber for housing said first connector of said housing.

3. The fitting structure of a lever connector according to claim 2, wherein said flexible locking arm are provided with a tilted face and a fitting pawl at the lower part thereof.

4. The fitting structure of a lever connector according to claim 1, wherein said flexible member comprises a projection which is provided inside a housing and is bent outside when a pressure larger than a predetermined value is applied to the housing outwardly.

5. A fitting method for a lever connector comprising, equipment attached to a housing, a first connector housed in said housing, a second connector directly attached to said equipment and fitted to said first connector when said equipment is attached to said housing, and a lever supported by said first connector so that the lever can be rotated to pull said second connector on the side of said first connector and fit both connectors completely, the fitting method comprising the steps of:

providing a flexible member initially engaged with the end of said lever and formed in said housing to allow said lever to rotate upon the displacement of said first connector in an equipment attachment direction;

completely fitting said first and second connectors to each other before the attachment of said equipment to said housing is completed;

bending said flexible member by said lever so as to disengage said lever from said flexible member when said first and second connectors are completely fitted and said lever is displaced in said housing in the equipment attachment direction in a state that the rotation of said lever is disabled; and completely attaching said equipment to said housing after said step of bending.

* * * * *